US010518569B2

(12) United States Patent
Campbell

(10) Patent No.: US 10,518,569 B2
(45) Date of Patent: Dec. 31, 2019

(54) SYSTEM AND METHOD FOR PREPARING THREE-DIMENSIONAL (3D) OBJECTS FOR SURFACE PRINTING

(71) Applicant: Xerox Corporation, Norwalk, CT (US)

(72) Inventor: Richard A. Campbell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 74 days.

(21) Appl. No.: 15/872,066

(22) Filed: Jan. 16, 2018

(65) Prior Publication Data

US 2019/0217645 A1 Jul. 18, 2019

(51) Int. Cl.

| | |
|---|---|
| ***B41M 5/00*** | (2006.01) |
| ***B41J 3/407*** | (2006.01) |
| ***B41J 11/00*** | (2006.01) |
| ***B41J 3/28*** | (2006.01) |
| *B41J 2/045* | (2006.01) |
| *B41F 17/00* | (2006.01) |

(52) U.S. Cl.

CPC ..... *B41M 5/0011* (2013.01); *B41J 3/28* (2013.01); *B41J 3/407* (2013.01); *B41J 11/0015* (2013.01); *B41F 17/005* (2013.01); *B41J 2/04505* (2013.01); *B41M 5/0088* (2013.01)

(58) Field of Classification Search

CPC ..... B41J 3/28; B41J 29/38; B41J 3/407; B41J 2/04505; B41M 5/0011; B41M 5/0088; B41F 17/005

See application file for complete search history.

(56) References Cited

U.S. PATENT DOCUMENTS

| | | | | |
|---|---|---|---|---|
| 9,266,354 | B2 * | 2/2016 | Moehringer | B41J 11/002 |
| 2002/0097280 | A1 | 7/2002 | Loper et al. | |
| 2002/0134257 | A1 | 9/2002 | Stephenson | |
| 2002/0191036 | A1 | 12/2002 | Park | |
| 2015/0158310 | A1 | 6/2015 | Olejniczak et al. | |
| 2015/0224765 | A1 | 8/2015 | Fukasawa | |
| 2015/0273864 | A1 | 10/2015 | Moehringer et al. | |

* cited by examiner

*Primary Examiner* — Thinh H Nguyen

(74) *Attorney, Agent, or Firm* — Maginot Moore & Beck LLP

(57) ABSTRACT

A printing system treats the surface of three-dimensional objects to be printed to improve the printing of the articles of manufacture. The system includes a surface treatment module that is positioned to part of the printing process and to treat the object surfaces prior to the surfaces being printed. The treatment of the surfaces within the module include operating an applicator to press a portion of a cleaning membrane against the surfaces of the three-dimensional objects to remove material from the object surfaces and to retract the applicator and cleaning membrane from the object surface to enable the objects to pass by an array of printheads for printing.

9 Claims, 10 Drawing Sheets

SYSTEM AND METHOD FOR PREPARING THREE-DIMENSIONAL (3D) OBJECTS FOR SURFACE PRINTING

TECHNICAL FIELD

This disclosure relates generally to a system for printing on three-dimensional (3D) objects, and more particularly, to systems for preparing a surface of such objects for printing.

BACKGROUND

Commercial article printing typically occurs during the production of the article. For example, ball skins are printed with patterns or logos prior to the ball being completed and inflated. Consequently, a retail establishment in a region in which potential product customers support multiple professional or collegiate teams needs to keep an inventory of products bearing the logos of the various teams. Ordering the correct number of products for each different logo to maintain the inventory can be problematic.

To address this issue, direct-to-object (DTO) printers have been developed. These printers are configured to pass an unprinted three-dimensional (3D) object past an array of printheads so the printheads can print an image on the object, such as a team logo. These printers enable the retail store or distribution center to maintain an inventory of unprinted objects and then print the objects to fill an order or make a sale to a customer. Prior to printing the objects, the surface of the object requires treatment to enable a smooth, durable image to be formed on the surface. Low cost surface treatments include hand buffing and isopropyl alcohol (IPA) or solvent wiping followed by surface drying. This surface preparation method requires a human to apply the treatment. Including surface treatment as part of the printing process and automating them would help remove the human variability in the results and avoid exposure of humans to solvents and other chemicals.

SUMMARY

A new DTO printer is configured to prepare the surface of three-dimensional (3D) objects and then feed the prepared objects to the printing process. The printing system includes a plurality of printheads, each printhead in the plurality of printheads being configured to eject marking material, a support member positioned to be parallel to a plane formed by the plurality of printheads, a member movably mounted to the support member, a first actuator operatively connected to the movably mounted member to enable the actuator to move the moveably mounted member along the support member, an object holder configured to mount to the movably mounted member to enable the object holder to pass the plurality of printheads as the moveably mounted member moves along the support member, a surface treatment module configured to treat a surface of an object held by the object holder prior to the object holder passing the plurality of printheads. The surface treatment module includes an applicator configured for reciprocating movement, a second actuator operatively connected to the applicator, the actuator being configured to move the applicator in reciprocating movement, a cleaning membrane positioned opposite the applicator, and a controller operatively connected to the plurality of printheads, the first actuator, and the second actuator. The controller is configured to operate the actuator to move the object holder through the surface treatment module, to operate the second actuator to press the cleaning membrane against a surface of the object held by the object holder and to retract the applicator from the surface of the object, to operate the actuator to pass the surface treated object past the plurality of printheads after the surface of the object has been treated with the cleaning membrane, and to operate the plurality of printheads to eject marking material onto the object held by the object holder as the object holder passes the plurality of printheads.

A new surface treatment module can be installed in an existing DTO printer to prepare the surfaces of objects to be printed. The surface treatment module includes an applicator configured for reciprocating movement, an actuator operatively connected to the applicator, the actuator being configured to move the applicator in reciprocating movement, a cleaning membrane positioned opposite the applicator.

A new method of operating a printer prepares the surface of three-dimensional (3D) objects and then feeds the prepared objects to the printing process. The method includes operating a first actuator with a controller to move an object holder mounted to a member that is movably mounted to a support member through a surface treatment module, operating a second actuator with the controller to press a cleaning membrane against a surface of an object held by the object holder and to retract the applicator from the surface of the object, operating the first actuator to pass the object past the plurality of printheads after the surface of the object has been treated with the cleaning membrane, to operate a plurality of printheads to eject marking material onto the object held by the object holder as the object holder passes the plurality of printheads.

BRIEF DESCRIPTION OF THE DRAWINGS

The foregoing aspects and other features of a DTO printer that prepares surfaces of 3D objects for printing are explained in the following description, taken in connection with the accompanying drawings.

DETAILED DESCRIPTION

Figure 1:
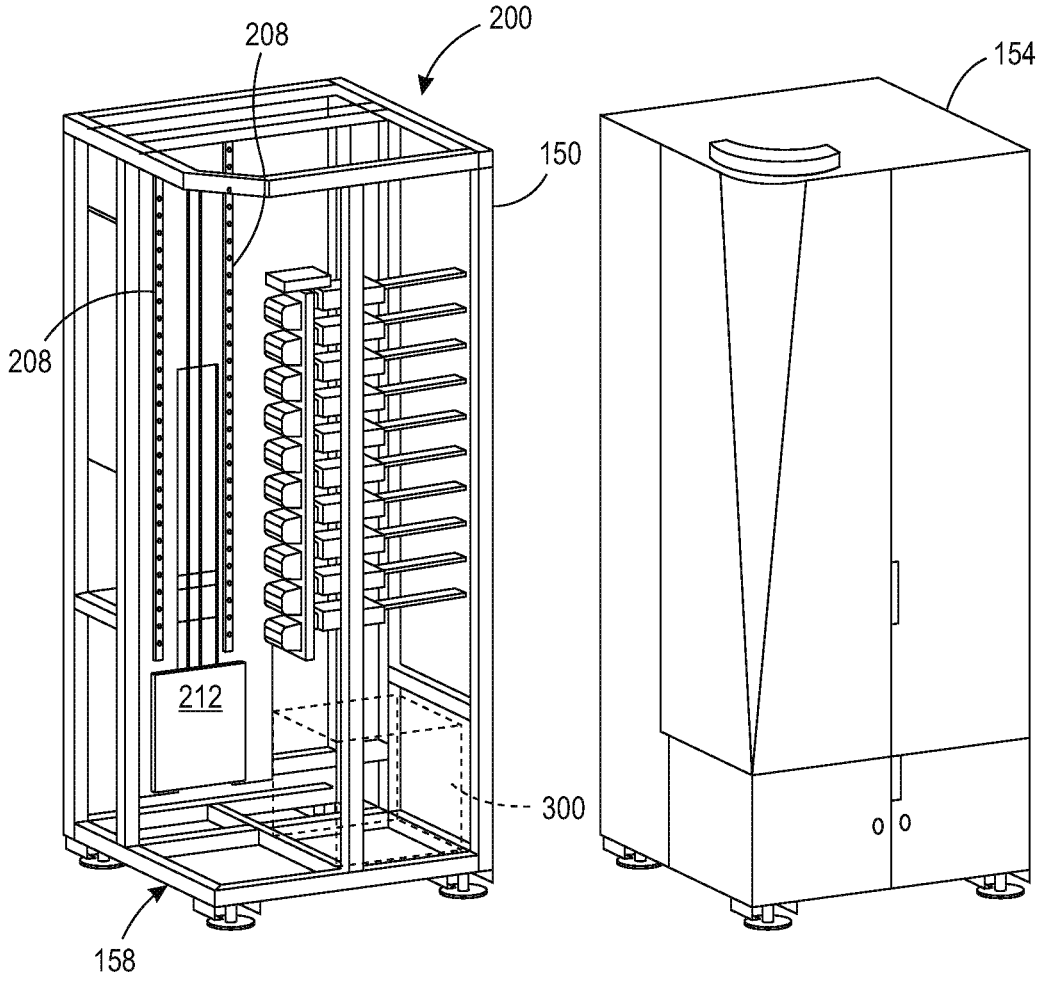
FIG. 1 illustrates an upright printing system within a cabinet having a surface treatment module that is configured to prepare a surface of a 3D object for printing.

For a general understanding of the present embodiments, reference is made to the drawings. In the drawings, like reference numerals have been used throughout to designate like elements.

Figure 8:
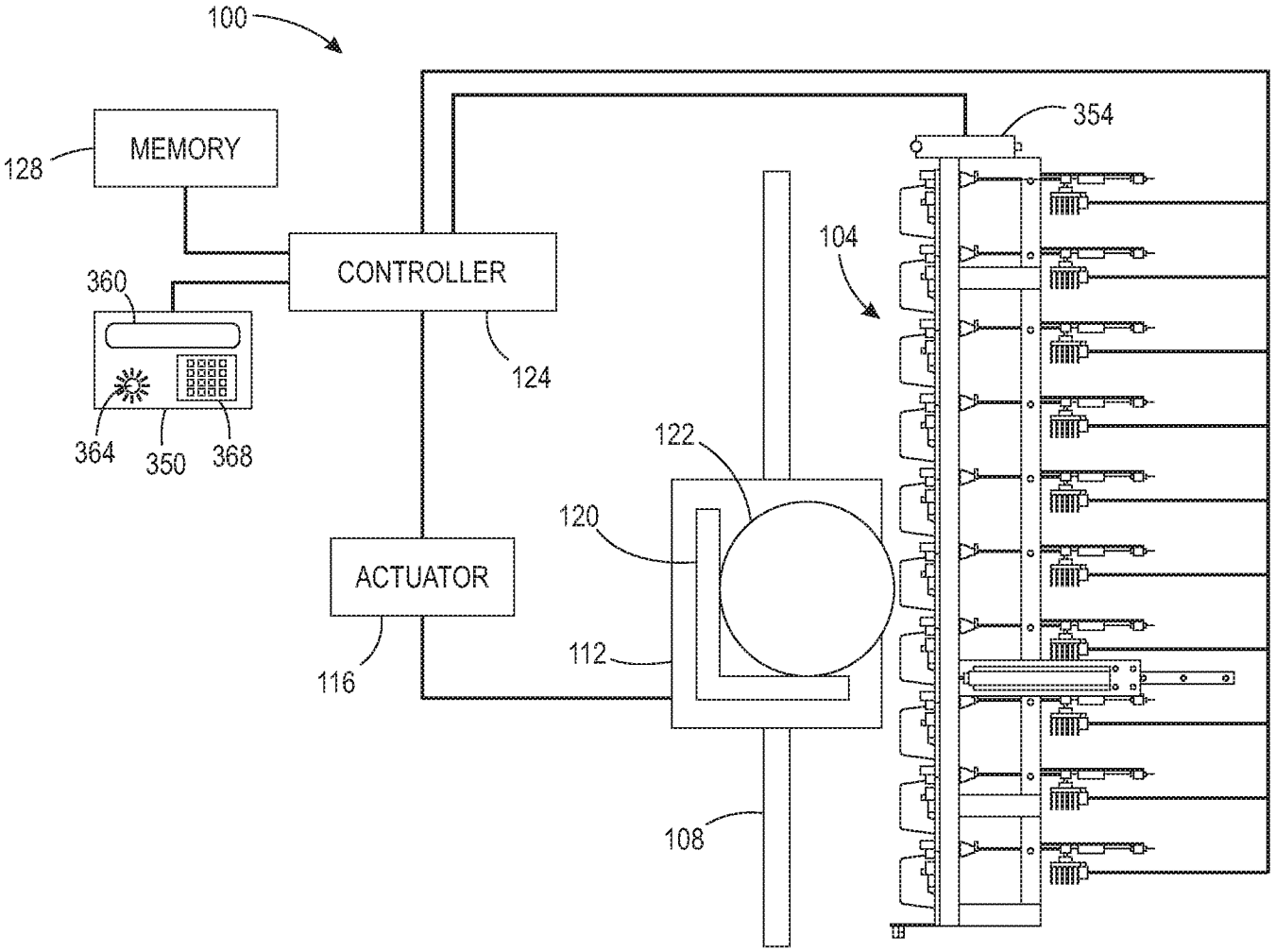
FIG. 8 PRIOR ART
FIG. 8 illustrates a prior art upright printing system configured to print a surface of a 3D object for printing.

FIG. 8 illustrates a prior art printing system 100 configured to print on a 3D object. The printing system 100 includes an array of printheads 104, a support member 108, a member 112 movably mounted to the support member 108, an actuator 116 operatively connected to the movably mounted member 112, an object holder 120 configured to mount to the movably mounted member 112, and a controller 124 operatively connected to the plurality of printheads and the actuator. As shown in FIG. 8, the array of printheads 104 is arranged in a two-dimensional array, which in the figure is a 10 by 1 array, although other array configurations can be used. Each printhead is fluidly connected to a supply of marking material (not shown) and is configured to eject marking material received from the supply. Some of the printheads can be connected to the same supply or each printhead can be connected to its own supply so each printhead can eject a different marking material. The controller 124 is also operatively connected to an optical sensor 354.

The support member 108 is positioned to be parallel to a plane formed by the array of printheads and, as shown in the figure, is oriented so one end of the support member 108 is at a higher gravitational potential than the other end of the support member. This orientation enables the printing system 100 to have a smaller footprint than an alternative embodiment that horizontally orients the array of printheads and configures the support member, movably mounted member, and object holder to enable the object holder to move objects horizontally past the arranged printheads so the printheads can eject marking material downwardly onto the objects.

The member 112 is movably mounted to the support member 108 to enable the member to slide along the support member. In some embodiments, the member 112 can move bi-directionally along the support member. In other embodiments, the support member 108 is configured to provide a return path to the lower end of the support member to form a track for the movably mounted member. The actuator 116 is operatively connected to the movably mounted member 112 so the actuator 116 can move the moveably mounted member 112 along the support member 108 and enable the object holder 120 connected to the moveably mounted member 112 to move vertically past the array of printheads 104. In the embodiment depicted in the figure, the object holder 120 moves a 3D object 122 in a process direction past the array of printheads 104. As used in this document, the term "process direction" refers to the axis along which an object is moved past a surface treatment module and printheads to enable the module to treat the surface of the object and then enable the printheads to print an image on the object. As used in this document, the term "cross-process direction" refers to the axis that is perpendicular to the process direction and that forms a plane with the process direction axis that is parallel to the array of printheads.

The controller 124 is configured with programmed instructions stored in a memory 128 operatively connected to the controller so the controller can execute the programmed instructions to operate components in the printing system 100. Thus, the controller 124 is configured to operate the actuator 116 to move the object holder 120 past the array of printheads 104 and to operate the array of printheads 104 to eject marking material onto objects held by the object holder 120 as the object holder passes the array of printheads 104. Additionally, the controller 124 is configured to operate the inkjets of the printheads within the array of printheads 104 to form images on a surface of the object 122.

The system configuration shown in FIG. 8 is especially advantageous in a number of aspects. For one, as noted above, the vertical configuration of the array of printheads 104 and the support member 108 enables the system 100 to have a smaller footprint than a system configured with a horizontal orientation of the array and support member. This smaller footprint of the system enables the system 100 to be installed within a frame 150 that is housed in a single cabinet 154 as depicted in FIG. 1. Once installed, various object holders can be used with the system to print a variety of goods that are generic in appearance until printed. Additionally, the controller 124 can be configured with programmed instructions to operate the actuator 116 to move the object holder at speeds that attenuate the air turbulence in the gap between the printhead and the object surface printed by the system 100.

Figure 9:
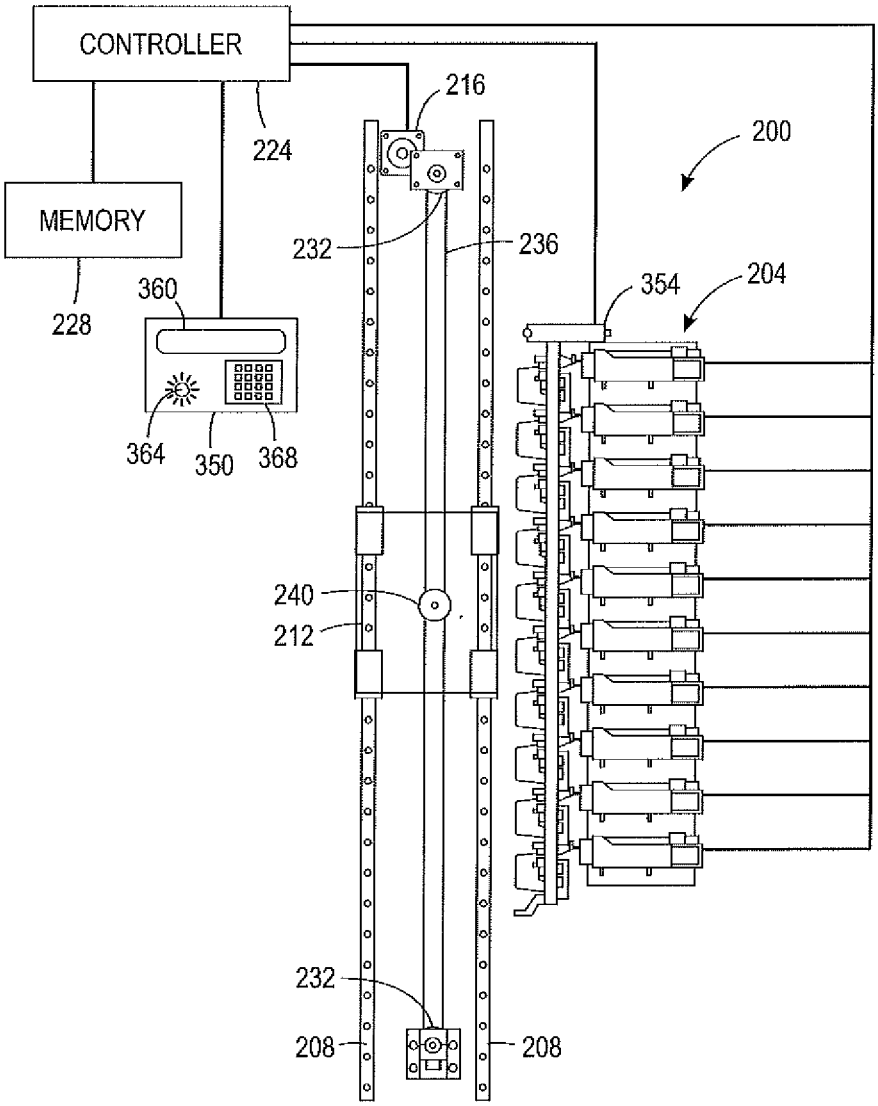
FIG. 9 PRIOR ART
FIG. 9 is a prior art printing system that uses a double support member to enable movement of objects past the array of printheads in the system of FIG. 7.

An alternative embodiment of the system 100 is shown in FIG. 9. In this alternative embodiment 200, the support member is a pair of support members 208 about which the moveably mounted member 212 is mounted. This embodiment includes a pair of fixedly positioned pulleys 232 and a belt 236 entrained about the pair of pulleys to form an endless belt. The moveably mounted member 212 includes a third pulley 240 that engages the endless belt to enable the third pulley 240 to rotate in response to the movement of the endless belt moving about the pair of pulleys 232 to move the moveably mounted member and the object holder mounted to the member 212. In this embodiment, the actuator 216 is operatively connected to one of the pulleys 232 so the controller 224 can operate the actuator to rotate the driven pulley and move the endless belt about the pulleys 232. The controller 224 can be configured with programmed instructions stored in the memory 228 to operate the actuator 216 bi-directionally to rotate one of the pulleys 232 bi-directionally for bi-directional movement of the moveably mounted member 212 and the object holder mounted to the member past the array of printheads 204.

FIG. 1 depicts the system 200 of FIG. 9 installed within a frame 150 of an enclosure, such as cabinet 154. The movably mounted member 212 is depicted at its lowest point of gravitational potential along the support member 208. At this position, the member 212 and any object held by the holder mounted to the member is not positioned where marking material can be ejected onto it by printhead array 204. Applicants have configured a surface treatment module 300, described more fully below, that fits within the space 158 of cabinet 154 that is below the printhead array 204. That is, the surface treatment module is positioned within the enclosure at a location having a lower gravitational potential than the printhead array 204. Thus, this module can treat surfaces of the object or objects held by the holder mounted to the member 212 before the surfaces are printed by the printhead array 204.

Figure 2:
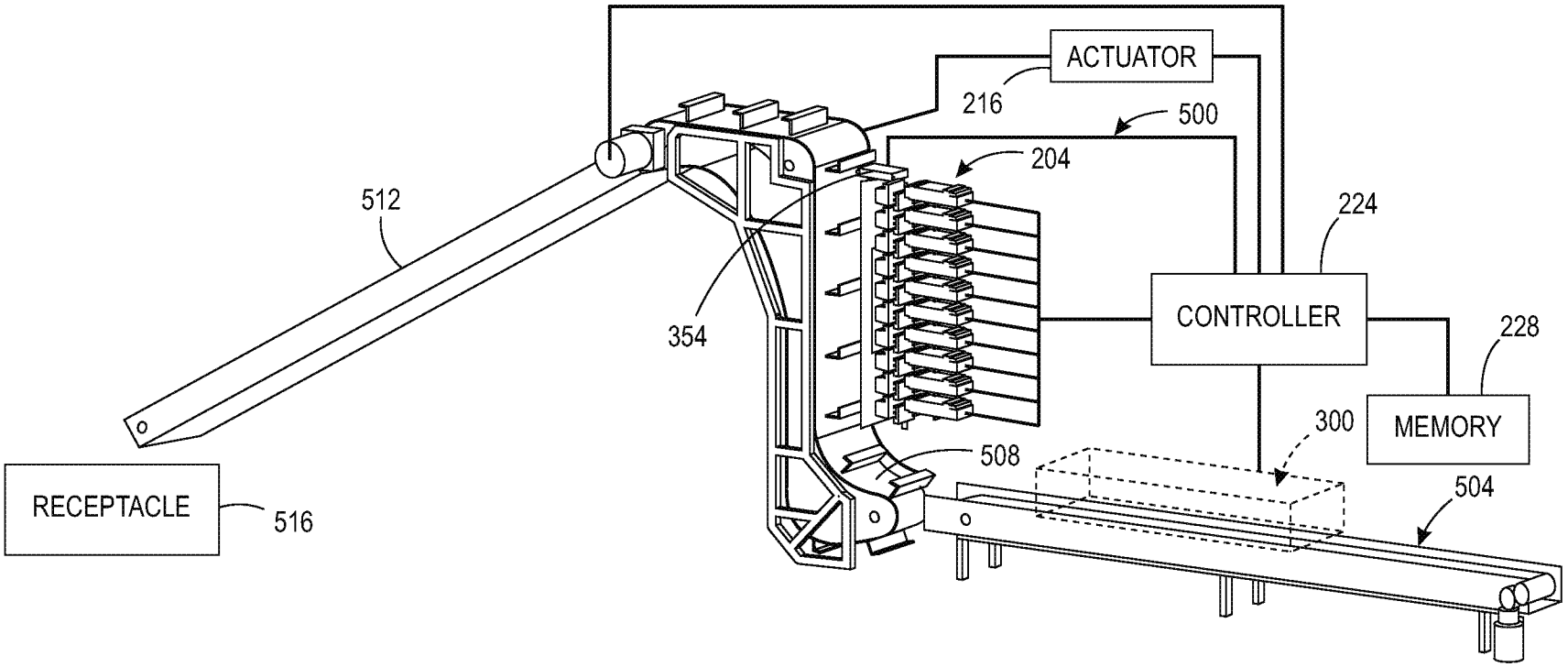
FIG. 2 is a horizontal printing system having a surface treatment module that is configured to prepare a surface of a 3D object for printing.

While the printing system 100 described above is especially advantageous in environments having space constraints for the printing system, the system 500 depicted in FIG. 2 is more robust and useful in manufacturing environments. In system 500, a conveyor 504 is configured to deliver objects from a supply of objects (not shown) to an object holder 508. The object holder 508 is configured to receive objects from the conveyor 504. The controller 224 is operatively connected to the conveyor 504, the actuator 216, and the array of printheads 204. The controller 224 is further configured with programmed instructions stored in the memory 228 to operate the conveyor 504 to deliver objects to the object holders 508 and to operate the actuator 216 to move the objects held by the object holders past the array of printheads 204. This operation enables the printheads to print the objects as the objects pass the array of printheads 204. A bin 516 can be provided to receive the objects from the object holders 508 after the objects have been printed. In the embodiment shown in FIG. 2, however, another conveyor 512 is configured to receive objects from the object holders 508 after the objects held by the object holders are printed by the printheads in the array of printheads 204. The controller 224 is operatively connected to the conveyor 512 and operates the conveyor 512 to transport the printed objects to a location away from the printing system, such as a receptacle 516. Similar to the cabinet 154 discussed above, the surface treatment module, such as module 300 shown in FIG. 1, can be positioned along the conveyor 504 to treat the surface of objects to be printed by the printhead array 204 before the objects are printed.

Figure 10A:
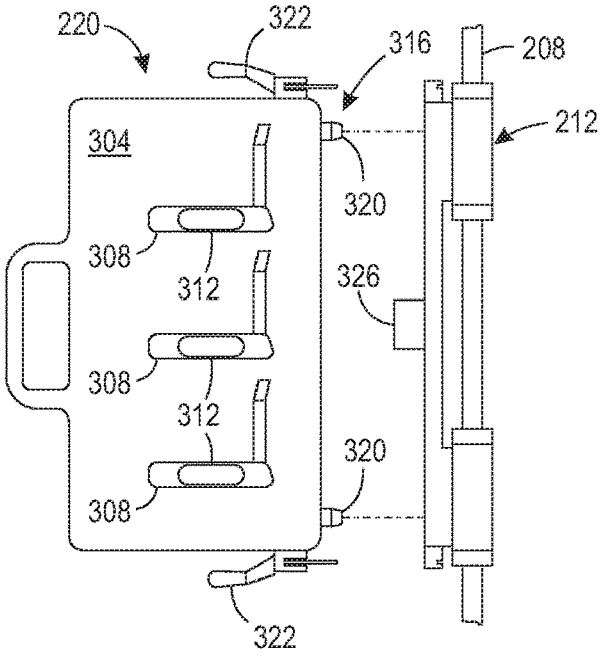
FIG. 10A PRIOR ART
FIGS. 10A and 10B depict a prior art object holder configured to identified an object to be printed by a printing system.
Figure 10B:
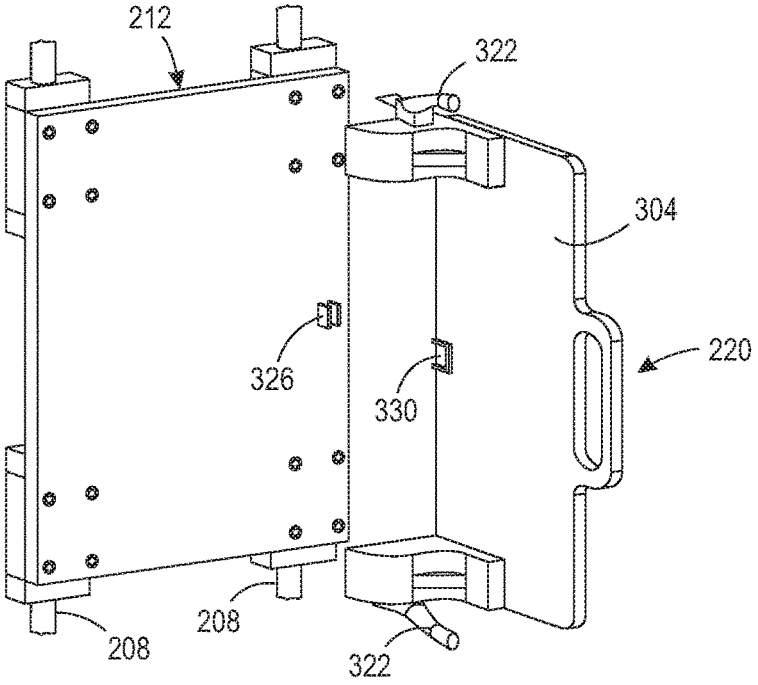
FIG. 10B PRIOR ART

An example of a prior art object holder 220 is shown in FIG. 10A and FIG. 10B. The object holder 220 includes a plate 304 having apertures 308 in which objects 312, which are golf club heads in the figure, are placed for printing. A latch 316 is configured for selectively mounting the object holder 220 to the movably mounted member 212. The latch 316 includes locating features 320 to aid in properly positioning the object holder 220 for securing the holder to the member 212 at a right angle to the planar portion of member 212, which is supported by members 208 as shown in FIG. 9. Once properly positioned, levers 322 operate the latch 316 to secure the holder 220 to the member 212. As shown in the figure, member 212 includes an input device 326 for obtaining an identifier from the object holder 220 as further described below.

A rear perspective view of the object holder 220 is shown in FIG. 10B. In that figure, an identification tag 330 on a surface of the object holder 220 faces the input device 326 on the movably mounted member 212 when the holder is secured to the member 212. The input device 326 is operatively connected to the controller 224, shown in FIG. 3, to communicate an identifier from the identification tag 330 to the controller. The controller is further configured to operate the array of printheads 204, the actuator 216, and the surface treatment modules, such as module 300 (FIG. 3), with reference to the identifier received from the input device 326 of the movably mounted member 212. As used in this document, "identification tag" means machine-readable indicia that embodies information to be processed by the printing system. The indicia can be mechanical, optical, or electromagnetic. In one embodiment, the identification tag 330 is a radio frequency identification (RFID) tag and the input device 326 of the movably mounted member is a RFID reader. In another embodiment, the identification tag 330 is a bar code and the input device 326 of the movably mounted member 212 is a bar code reader. In another embodiment in which mechanical indicia are used for the identification tag, the indicia are protrusions, indentations, or combinations of protrusions and indentations in a material that can be read by a biased arm following the surface of the identification tag. The input device 326 in such an embodiment can be a cam follower that converts the position of an arm that follows the mechanical features into electrical signals. The controller of the printing system receives the data embodied in the identification tag and uses this data to operate the surface treatment module 300 that is incorporated in the printing systems shown in FIG. 1 and FIG. 2.

The controller of the printing system is also configured with programmed instructions stored in the memory 228 to compare the identifier received from the input device 326 of the movably mounted member 212 to identifiers stored in the memory 328 operatively connected to the controller. The controller disables operation of the actuator 216, the printhead array 204, the surface treatment module 300, or all three, in response to the identifier received from the input device 326 failing to correspond to one of the identifiers stored in the memory. The controller of the printing system is also operatively connected to a user interface 350 as shown in FIG. 8 and FIG. 9. The interface 350 includes a display 360, an annunciator 364, and an input device 368, such as a keypad. The controller 224 is configured with programmed instructions to operate the user interface to notify an operator of the failure of the identifier received from the input device 326 to correspond to one of the identifiers in memory. Thus, the operator is able to understand the reason for the disabling of the system. The user interface 350 includes a display 360 for alphanumeric messages, a keypad 368 for entry of data by an operator, and an annunciator 364, such as a warning light or audible alarm, to attract attention to displayed messages. The controller 224 also uses the identifier to control the operation of the surface treatment module. For example, the controller 224 can use the identifier to control the length of time an object surface is subjected to the chemical cleaning operation performed by module 300.

Figure 3:
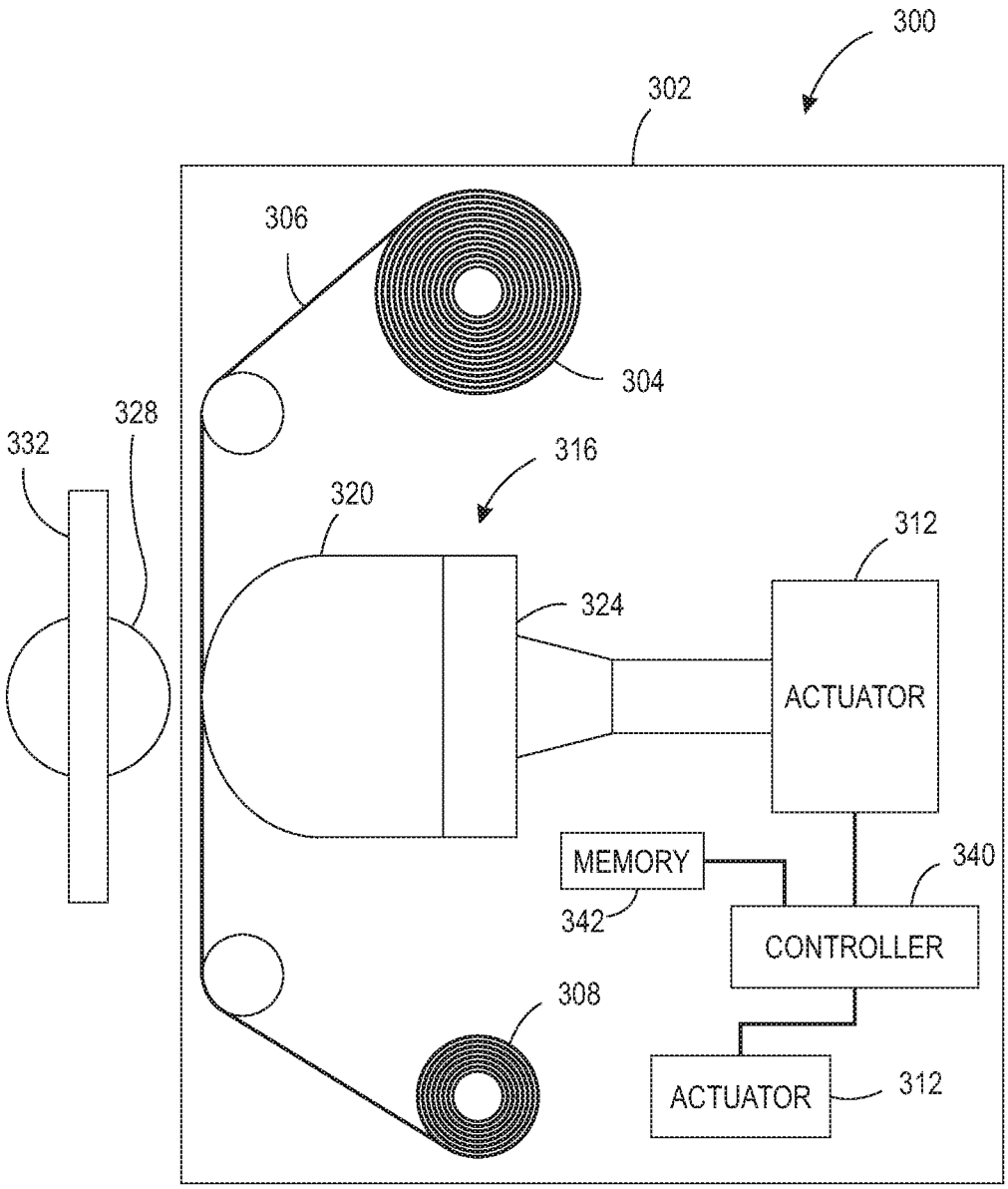
FIG. 3 depicts a top view of one embodiment of the surface treatment module configured to prepare a surface of a 3D object for printing.

A top view of a surface treatment module 300 that can be incorporated with the system 200 in the cabinet 154 is shown in FIG. 3. As used in this document, the words "treat" and "treatment" mean an operation performed on an object surface to alter or modify a property of the surface to enhance the ability of the surface to receive marking material ejected by the printheads. The module 300 includes a housing 302 in which a supply roll 304 of cleaning membrane 306 and a take-up roll 308 for moving the cleaning membrane 306 through the system 300 are provided. An actuator 312 is operatively connected to the take-up roll 308 to rotate the roll and pull cleaning membrane from the supply roll 304. Interposed between the supply roll 304 and the take-up roll 308 is an applicator 316. Applicator 316 includes a compression member 320 that is mounted to a support 324. As used in this document, the term "compression member" refers to any deformable object useful for pressing a sheet material into engagement with the surface of 3D object to be treated so the sheet conforms with the features of the 3D object. Another actuator 312 is operatively connected to the support 324 to move the support 324 and the compression member 320 is a reciprocating manner. A controller 340 is operatively connected to the actuators 312 and is configured with programmed instructions stored in the memory 342 to operate the actuators 312 as described more fully below. While module 300 is shown with a controller 340 that is separate from the controller 224 that operates the printer 200 or the controller 224 can be further configured to operate the actuators 312 within the module 300. In that latter situation, the module 300 is provided with an interface to operatively connect the controller 224 to the actuators 312.

Figure 4:
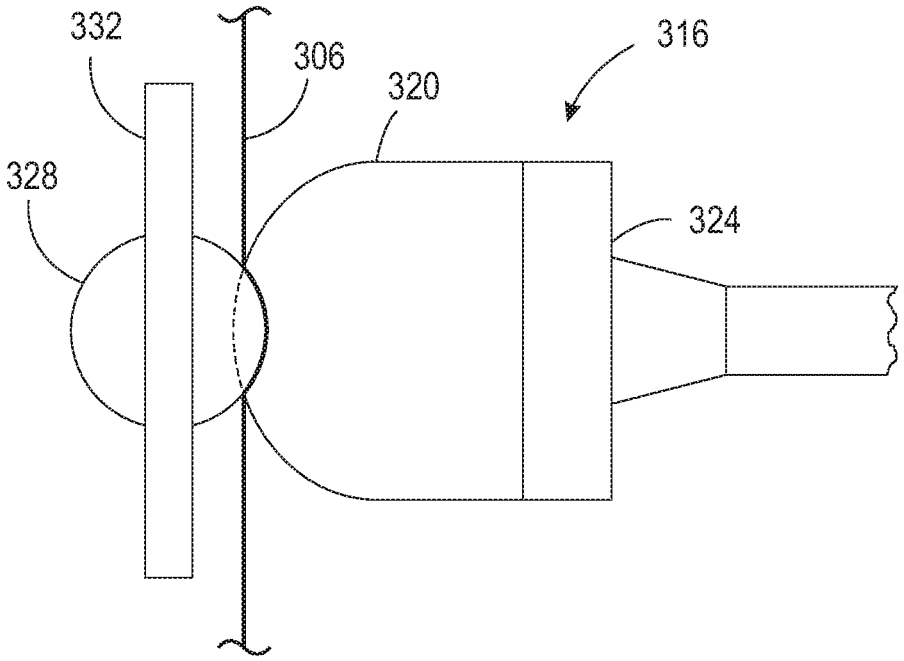
FIG. 4 depicts a top view of the embodiment shown in FIG. 3 engaging the surface of an object.

The compression member 320 is made of a pliable material of a relatively soft durometer that enables the compression member to deform as the actuator 312 pushes the compression member 320 against the portion of the cleaning membrane 306 that is directly opposite the compression member 320 into an object 328 held by object holder 332. This deformation enables the compression member 320 to spread across the cross-process direction on the object 328 a distance that is slightly larger than a single row in the printhead array 204 at a depth that corresponds to the focus distance of a printhead. If the printhead array is only one printhead wide, as is the case in the ten printheads in a single column noted above, this distance need only be a little larger than one printhead wide. If multiple printheads are in a row of the printhead array, then the compression member 320 is sized to expand a distance slightly larger than a width of a row in the printhead array. In one embodiment, the focus distance of a printhead in the printhead array 204 is about 15 mm. A top view of a deformation of the compression member 320 against an object 328 is shown in FIG. 4.

The cleaning membrane 306 is a non-woven, lint-free fabric that can stretch sufficiently to absorb the deformation of the compression member 320 without breaking. Such a fabric can be a cellulose/polyester blend, a rayon/cellulose blend, a polypropylene/cellulose blend, a rayon/polyester blend, or a 100% polypropylene material. The cleaning membrane 306 is pre-wetted on the supply roll 304 with cleaning agents, such as water, isopropyl alcohol (IPA), solvents, surfactants, and solutions containing multiple agents from this list. For example, in one embodiment, the cleaning fabric is pre-wetted with a 70%/30% solution of water and IPA, respectively. These agents affect the surface tension of the object where the agents contact the object. Surface tension refers to a force present in the surface that holds a fluid together in the presence of air. That is, surface tension refers to the tangential intermolecular force of attraction between adjacent molecules of the fluid. Surface tension dictates whether a coating wets and spreads over, or retracts from, a solid surface. Surface tension is expressed as force per unit of width, such as dynes/cm or mN/m. Water has a high surface tension in the range of 72 dynes/cm, while alcohols have a low surface tension in the range of 20 to 22 dynes/cm. Solvents typically used in solvent borne agent formulations are in the 20-30 dynes/cm range. Likewise, surfactants have a relatively low surface tension and are applied to reduce surface tension. The application of these agents or solutions of these agents help clean the surface of an object before printing and can enhance the ability of the object surface to hold the drops of ink ejected onto the surface until they dry and adhere to the object.

Materials for the compression member include, but are not limited to, silicone and polyurethane. The material requires a hardness, which is measured in durometers, appropriate for the amount of deformation for the size and shape of the area to be treated. The deformed compression member needs to be marginally larger than the area to be treated to ensure complete treatment of the area. In some embodiments, the compression member has a hardness in the range of about 60 durometers to about 80 durometers. In embodiments that treat more delicate or fragile objects, a softer hardness in the range of about 35 durometers to about 60 durometers can be used. In embodiments that treated more resilient or rigid objects, the hardness of the compression member can be greater than 80 durometers. All the durometer measurements are made with reference to the Shore 00 scale.

Figure 5A:
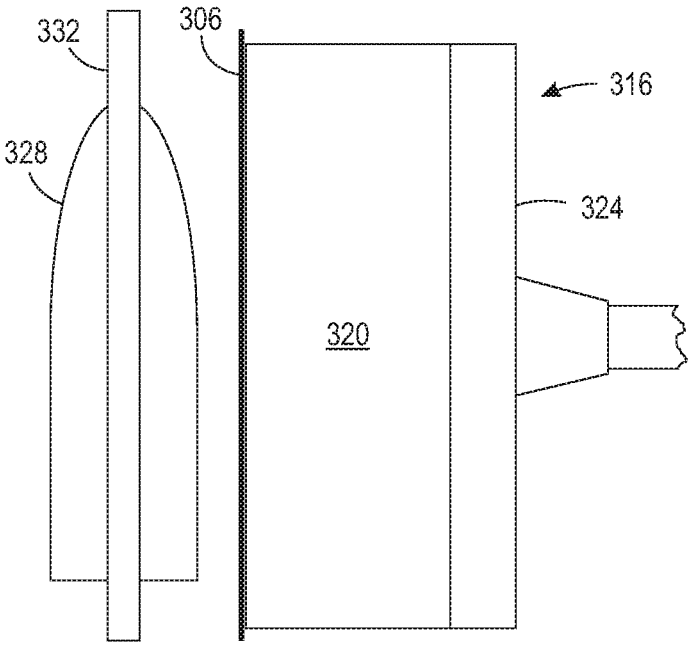
FIG. 5A is a side view of the embodiment shown in FIG. 3 and FIG. 4.
Figure 5B:
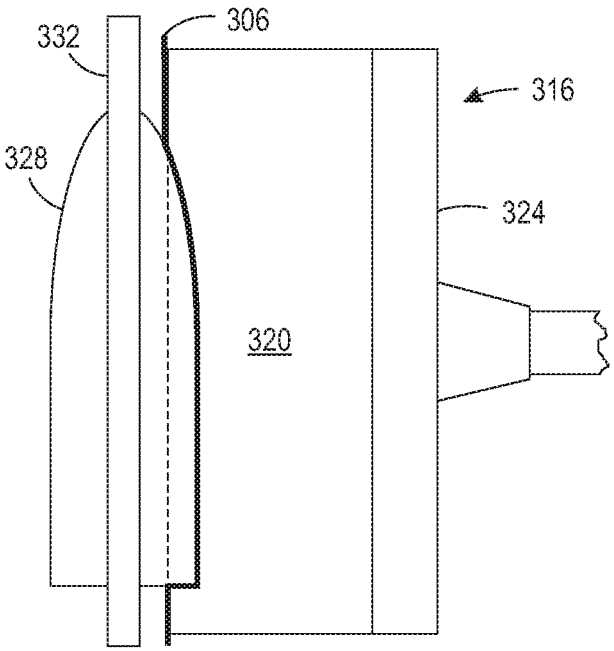
FIG. 5B is a side view of the embodiment shown in FIG. 3 and FIG. 4 engaging the surface of an object.

A side view of the system 300 prior to the compression member 320 urging the cleaning membrane 306 into the object 328 is shown in FIG. 5A. In FIG. 5A and FIG. 5B, the cleaning fabric 306 is represented in cross-section as contacting the compression member 320 at its end most distal from the support 324 so the structure of the applicator 316 can be viewed. As shown in FIG. 5A, the compression member 320 has a length in the process direction that is longer than the length of the object in this direction to ensure the area of the object to be printed is treated by the system 300. A side view of the system 300 with the compression member 320 urging the cleaning membrane 306 into the object 328 is shown in FIG. 5B. After the compression member 320 presses the cleaning membrane 306 into the object 328 to treat the surface of the object 328 that is printed by the printhead array 204, the controller operates the actuator 312 to retract the compression member to the position shown in FIG. 5A and FIG. 4 so the object 328 can be moved past the printhead array 204. After the compression member 320 is retracted and the cleaning membrane 306 no longer contacts the object 328, the controller operates the actuator 312 operatively connected to the take-up roll 308 to pull the portion of the cleaning membrane contaminated by contact with the surface of the object 328 toward the roll 308 a distance sufficient to ensure the contaminated portion of the cleaning membrane is not applied to the next object.

Figure 6A:
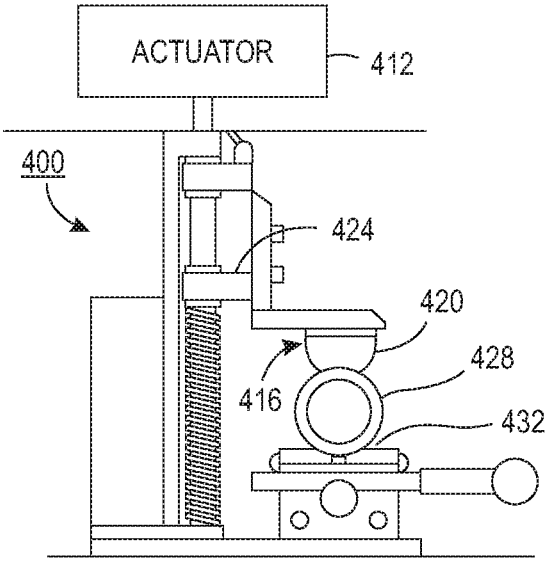
FIG. 6A is a front view of an embodiment of a surface treatment module that is external to a DTO printer.
Figure 6B:
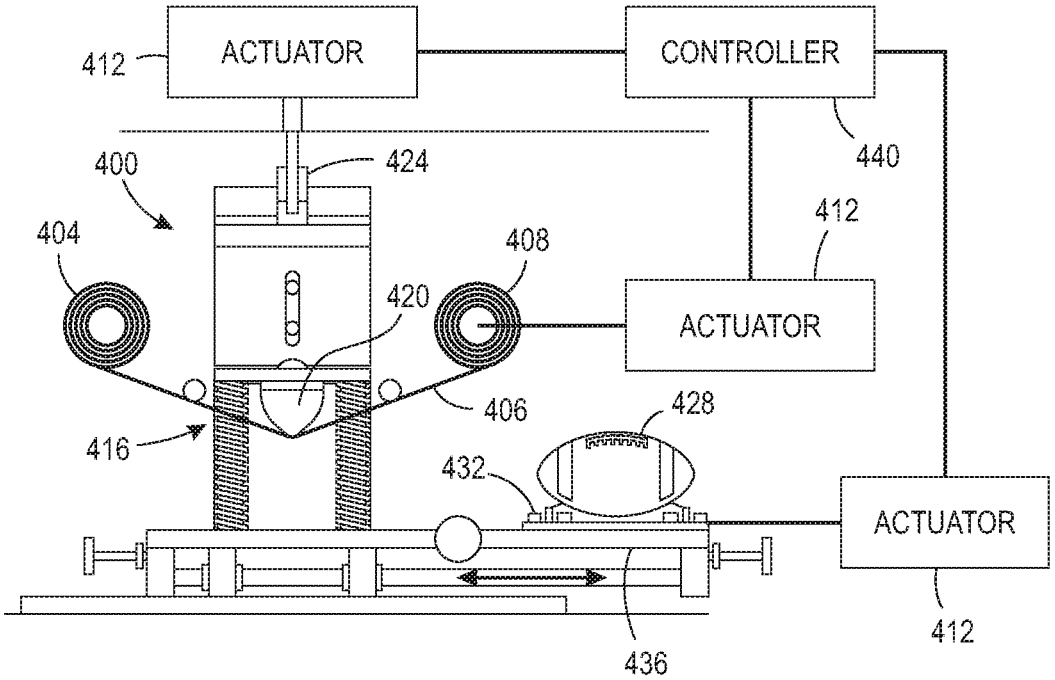
FIG. 6B is a side view of the embodiment of the surface treatment module shown in FIG. 6A as an object is being treated.

A treatment system 400 that is external to a DTO printer is shown in side view in FIG. 6A and in front view in FIG. 6B. The object 428 in these figures is a football. The system 400 includes an object holder 432 that is movably mounted to a support member 436 to enable the object 428 to be mounted in the holder 432, moved to a position opposite the compression member 420 for surface treatment, and then returned to the object starting position. An actuator 412 is operatively connected to the object holder 432 and is configured to move the holder as just described. The view in FIG. 6B shows the supply roll 404, the take-up roll 408, and the cleaning membrane 406, but those components are not depicted in FIG. 6A to enable the other components of the system 400 to be viewed. An applicator 416 having a compression member 420 is mounted to support member 424 in a manner similar to that described above with regard to FIG. 4, but is rotated ninety degrees in FIGS. 6A and 6B. Another actuator 412 is operatively connected to the support member 424 to move the compression member 320 into engagement with the cleaning membrane 406 and the cleaning membrane 406 into the object 428 for surface treatment of the object. The controller 440 is operatively connected to the actuators 412 and is configured to operate the actuators to move the object 428 to the position for treatment and for release from the system and to move the compression member 420 and cleaning membrane 406 into and out of engagement with the surface of the object 428 when the object is positioned opposite the compression member 420. Objects treated by the system 400 are mounted into an object holder for a DTO printer after the object has been treated and returned to the starting position.

Figure 7:
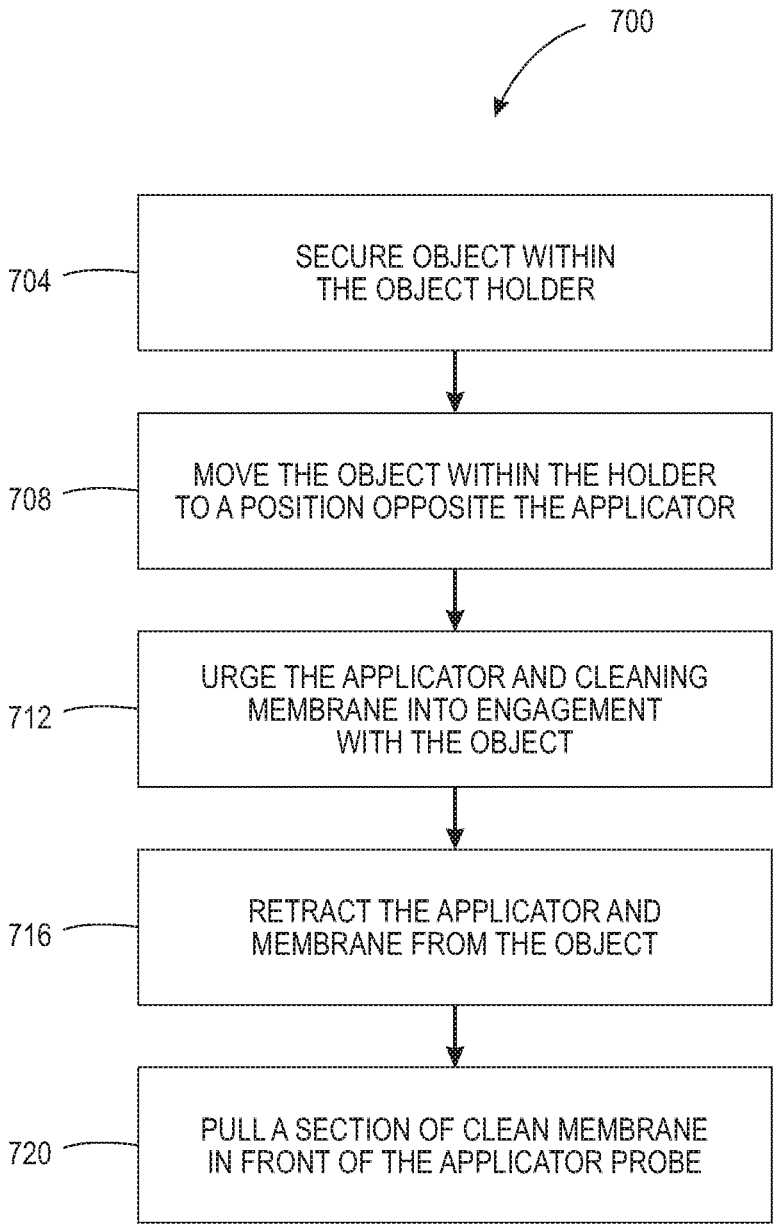
FIG. 7 is a flow diagram of a process for operating a DTO printer to treat the surface of a 3D object prior to printing.

A method 700 for operating a printer to treat a surface of an object is shown in FIG. 7. In the description of the process, a reference to the process 700 performing a function or action refers to the operation of a controller to execute stored programmed instructions to perform the function or action in association with other components in an inkjet printer. The process 700 is described in conjunction with the printer 100 and the embodiments of FIG. 3 for illustrative purposes.

The process 700 begins with an object 328 being secured within the holder 332 (block 704). The controller 224 operates actuator 216 to move the object 328 opposite the compression member 320 (block 708). The controller 224 or 340 then operates the actuator 312 to move the compression member 320 into engagement with the cleaning membrane 306 and then continues to deform the compression member against the object and press the cleaning membrane on the surface of the object (block 712). After the compression member has traveled the extend of its movement, the controller operates the actuator 312 to retract the compression member 320 to its starting position (block 716). As the controller 224 operates the actuator 216 to move the object 328 and the holder 332 past the printhead array 204, the controller 224 or 340 also operates the actuator 312 to rotate the take-up roll 308 and pull the section of the cleaning membrane 306 toward the take-up roll so a uncontaminated portion of the cleaning membrane is positioned opposite the compression member 320 (block 720). The process is repeated once the object is printed and removed from the printer and a next object is secured within the holder 332.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printing system comprising:

a plurality of printheads, each printhead in the plurality of printheads being configured to eject marking material;

a support member positioned to be parallel to a plane formed by the plurality of printheads;

a member movably mounted to the support member;

a first actuator operatively connected to the movably mounted member to enable the actuator to move the moveably mounted member along the support member;

an object holder configured to mount to the movably mounted member to enable the object holder to pass the plurality of printheads as the moveably mounted member moves along the support member;

a surface treatment module configured to treat a surface of an object held by the object holder prior to the object holder passing the plurality of printheads, the surface treatment module comprising:

an applicator configured for reciprocating movement;

a second actuator operatively connected to the applicator, the actuator being configured to move the applicator in reciprocating movement;

a cleaning membrane positioned opposite the applicator; and a controller operatively connected to the plurality of printheads, the first actuator, and the second actuator, the controller being configured to operate the actuator to move the object holder through the surface treatment module, to operate the second actuator to press the cleaning membrane against a surface of the object held by the object holder and to retract the applicator from the surface of the object, to operate the actuator to pass the surface treated object past the plurality of printheads after the surface of the object has been treated with the cleaning membrane, and to operate the plurality of printheads to eject marking material onto the object held by the object holder as the object holder passes the plurality of printheads.

2. The printing system of claim 1 further comprising:

an enclosure;

a frame configured to fit within the enclosure; and the plurality of printheads, the support member, and the surface treatment module being arranged vertically within the frame to position the surface treatment module at a position that has a gravitational potential within the enclosure that is lower than a gravitational potential at the plurality of printheads.

3. The printing system of claim 1 further comprising:

a first conveyor configured to move objects to the object holder prior to the object holder passing the plurality of printheads; and the surface treatment module is positioned along the first conveyor to enable the second actuator to press the cleaning membrane against the surfaces of the objects to treat the surfaces of each object prior to the objects being moved to the object holder.

4. The printing system of claim 1, the surface treatment module further comprising:

a supply roll of the cleaning membrane;

a take-up roll configured to engage one end of the cleaning membrane, the supply roll and the take-up roll being positioned on opposite sides of the applicator;

a third actuator operatively connected to the take-up roll, the second actuator being configured to rotate the take-up roll to pull cleaning membrane from the supply roll past the applicator; and the controller being further configured to operate the third actuator to rotate the take-up roll and rotate the take-up roll to pull cleaning membrane from the supply roll past the applicator.

5. The printing system of claim 4, the controller is further configured to:

operate the third actuator to pull a length of cleaning membrane from the supply roll that enables a portion of the cleaning membrane that was pressed into the object to move past the applicator and be replaced by another portion of the cleaning membrane that has not touched the object in the holder.

6. The printing system of claim 5 wherein the cleaning membrane is a lint-free, non-woven fabric pre-wetted with a cleaning agent.

7. The printing system of claim 6 wherein the cleaning agent is a solution of water and isopropyl alcohol.

8. The printing system of claim 1, the applicator of the surface treatment module further comprising:

a support member;

a compression member mounted to the support member; and the second actuator is operatively connected to the support member to move the support member in the reciprocating movement to press the compression member into the cleaning membrane and the cleaning membrane against the surface of the object and to retract the compression member and the cleaning membrane from the surface of the object.

9. The printing system of claim 8 wherein the compression member is made of a flexible material having a durometer that enables the compression member to deform about a portion of the object.

* * * * *